US007016629B2

(12) United States Patent
Ishii et al.

(10) Patent No.: US 7,016,629 B2
(45) Date of Patent: Mar. 21, 2006

(54) IMAGE FORMING APPARATUS WITH DISCHARGING UNIT OF INCREASED CAPACITY

(75) Inventors: Hiroshi Ishii, Kanagawa (JP); Yuusuke Noguchi, Kanagawa (JP); Kazuosa Kuma, Kanagawa (JP); Makoto Kikura, Kanagawa (JP); Yutaka Fukuchi, Kanagawa (JP); Kazuki Suzuki, Saitama (JP); Tomohiko Sasaki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/825,431

(22) Filed: Apr. 16, 2004

(65) Prior Publication Data

US 2004/0208676 A1 Oct. 21, 2004

(30) Foreign Application Priority Data

Apr. 17, 2003 (JP) ..... 2003-113245
Apr. 17, 2003 (JP) ..... 2003-113256

(51) Int. Cl.
*G03G 15/08* (2006.01)

(52) U.S. Cl. ..... 399/258

(58) Field of Classification Search ..... 399/258, 399/262, 298, 299, 302, 306, 308, 405
See application file for complete search history.

(56) References Cited

U.S. PATENT DOCUMENTS 5,040,025 A 8/1991 Fukuchi
5,052,336 A 10/1991 Fukuchi
5,055,881 A 10/1991 Fukuchi
5,109,254 A 4/1992 Oka et al.
5,124,759 A 6/1992 Fukuchi et al.
5,300,996 A 4/1994 Yokoyama et al.
5,329,340 A 7/1994 Fukuchi et al.
5,479,247 A 12/1995 Watanabe et al.
5,689,764 A 11/1997 Fukuchi et al.
RE36,124 E 3/1999 Yokoyama et al.
5,887,239 A * 3/1999 Hong et al. ..... 399/405
5,913,095 A 6/1999 Takashima et al.
6,128,451 A 10/2000 Fukuchi
6,181,899 B1 1/2001 Fukuchi
6,374,066 B1 * 4/2002 Smith et al. ..... 399/107
6,385,418 B1 5/2002 Fukuchi
6,576,177 B1 6/2003 Fukuchi
6,647,223 B1 11/2003 Ishii
6,674,982 B1 1/2004 Saitoh et al.
6,757,515 B1 6/2004 Ueda (Continued)

FOREIGN PATENT DOCUMENTS

JP 63-23182 1/1988

(Continued)

*Primary Examiner*—Quana Grainger
(74) *Attorney, Agent, or Firm*—Oblon, Spivak, McClelland, Maier & Neustadt, P.C.

(57) ABSTRACT

An image forming apparatus is disclosed, that includes multiple imaging units, a loading unit formed on the top face of the main body of the image forming apparatus, and a discharging unit disposed at the operation side of the main body. The image forming apparatus further includes multiple developer containing members disposed in the main body for providing the corresponding imaging units with developer, the developer containing members being arranged in a direction extending from the operation side of the main body. The developer containing members are detachable from the main body of the image forming apparatus, and can be handled in a space above the image forming apparatus, the space being limited to the width of the main body.

38 Claims, 7 Drawing Sheets

U.S. PATENT DOCUMENTS

| | | | | |
|---|---|---|---|---|
| 6,801,742 | B1 * | 10/2004 | Mochimaru et al. | 399/309 |
| 2002/0051646 | A1 * | 5/2002 | Mochimaru et al. | 399/45 |

FOREIGN PATENT DOCUMENTS

| | | | |
|---|---|---|---|
| JP | 63-137260 | | 6/1988 |
| JP | 06175332 | A * | 6/1994 |
| JP | 09030708 | * | 2/1997 |
| JP | 11352743 | A * | 12/1999 |
| JP | 2002-214868 | | 7/2002 |
| JP | 2002-362807 | | 12/2002 |
| JP | 2003-20351 | | 2/2003 |
| JP | 2003-050531 | | 2/2003 |
| JP | 2003177592 | A * | 6/2003 |
| JP | 2003202728 | A * | 7/2003 |

* cited by examiner

IMAGE FORMING APPARATUS WITH DISCHARGING UNIT OF INCREASED CAPACITY

BACKGROUND OF THE INVENTION

1. Field of the Invention

The present invention generally relates to an image forming apparatus, and more particularly, to an image forming apparatus such as a color printer, a color copier, a color facsimile machine, and a multifunctional peripheral.

2. Description of the Related Art

Image forming apparatuses of the electrophotography method can print color images on recording media such as paper and film. Toner of four colors is generally used for color printing. As a result, a color image forming apparatus requires more components than a monochrome image forming apparatus does. Color printing takes more time than monochrome printing does.

Personal computer (PC) users often dispose image forming apparatuses around their PCs, and use the image forming apparatuses as printers. Accordingly, it is desired that an image forming apparatus be short in height and small in footprint.

Users often replace consumable supplies and maintain image forming apparatuses by themselves so as to save time and reduce maintenance cost.

There are two well-known color printing methods, the one drum method and the tandem method.

The one drum method uses one photosensitive unit and multiple developing units disposed around the photosensitive unit. The photosensitive unit is rotated for as many cycles as the number of colors. A monochrome toner image is formed by a developing unit on the photosensitive unit during each cycle of rotation, and superposed into a full color toner image. Finally, the full color toner image is transferred to a recording medium.

The tandem method uses multiple photosensitive units arranged in a line and multiple developing units disposed close to respective photosensitive units. A monochrome toner image is formed by a developing unit on a photosensitive unit, and each monochrome toner image is transferred to a recording medium one by one thereby to form a full color image on the recording medium.

The tandem method is advantageous over the one drum method in increasing printing speed. However, the tandem method consumes more toner than the one drum method does. It is preferred that a developer supply unit, which provides toner (developer) to the developing unit, be provided separately from the developing unit. A separate developer supply unit may be easier to handle than a developer supply unit provided with the developing unit in the same cartridge.

It is preferred that the main body of the image forming apparatus not only be small in footprint, but also have no member protruding therefrom. The top face of the main body may be used as a loading unit on which printed recording media are loaded.

Document No. 1 listed below discloses an image forming apparatus in which a loading unit is formed on the top face of the image forming apparatus, and a developer supply unit is provided separately from a developing unit.

Document No. 2 listed below discloses an image forming apparatus including multiple photosensitive units arranged in a line, multiple developing units arranged in a line, and an intermediate transfer belt; the photosensitive unit, the developing units, and the intermediate transfer belt being disposed at a slant (inclined), instead of horizontally as disclosed in document No. 1, thereby to reduce the footprint thereof.

Document No. 3 listed below discloses an image forming apparatus in which a loading unit is slanted thereby to increase the amount of recording media that can be loaded on the loading unit.

The following documents are known to describe the related art: Japanese Laid-Open Patent Applications No. 2002-362807 (Document No. 1), No. 2002-214868 (Document No. 2), and No. 2003-50531 (Document No. 3).

SUMMARY OF THE INVENTION

Accordingly, it is a general object of the present invention to provide a novel and useful image forming apparatus in which at least one of the above problems is eliminated.

Another and more specific object of the present invention is to provide an image forming apparatus that is easily operable, and consumable supplies of which can be easily replaced.

Yet another object of the present invention is to provide an image forming apparatus that is small in footprint, but can load a large amount of printed recording media.

To achieve at least one of the above objects, an image forming apparatus according to an aspect of the present invention, includes:

a plurality of imaging units;

a loading unit formed on a top face of a main body of the image forming apparatus;

a discharging unit disposed at an operation side of the main body, wherein an image-formed recording medium is discharged through the discharging unit to the loading unit; and a plurality of developer containing members disposed in the main body, the developer containing members being arranged in directions extending from the operation side of the main body, wherein the developer containing members provide the respective imaging units with developer, wherein the plurality of developer containing members are detachable from the main body of the image forming apparatus, and can be handled in a space above the image forming apparatus.

According to the above arrangements, the developer containing members can be replaced within the space above the main body, limited to the width of the main body.

An image forming apparatus according to another aspect of the present invention, includes:

a plurality of imaging units;

a loading unit formed on a top face of a main body of the image forming apparatus;

a discharging unit disposed at an operation side of the main body, wherein an image-formed recording medium is discharged through the discharging unit to the loading unit; and a plurality of developer containing members disposed in the main body, the developer containing members being arranged in directions extending from the operation side of the main body, wherein the developer containing members provide the respective imaging units with developer, wherein the developer containing member closest to the discharging unit is disposed at a lower position than the developer containing member most distant from the discharging unit.

According to the above arrangements, the developer containing members are arranged in a manner in which the more distant from the discharging unit the developer containing member is, the higher the developer containing member is disposed. The loading unit can be disposed at a sufficiently distant position from the discharging unit.

Other objects, features, and advantages of the present invention will become more apparent from the following detailed description when read in conjunction with the accompanying drawings.

DETAILED DESCRIPTION OF THE PREFERRED EMBODIMENTS

Figure 1:
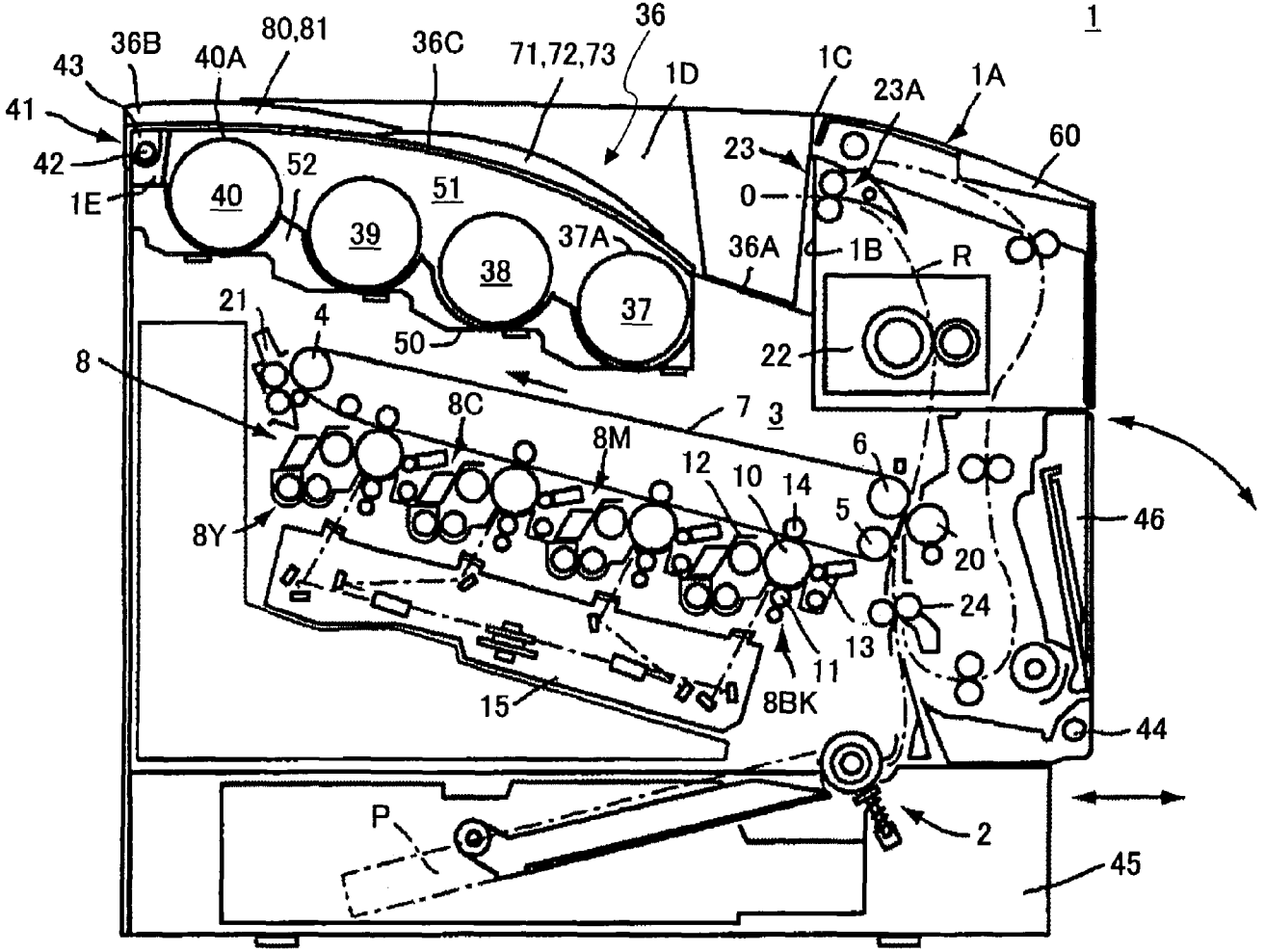
FIG. 1 is a cross-sectional view showing the structure of an image forming apparatus according to an embodiment.

The inventions disclosed in the above documents have solved various problems. However, the operability of image forming apparatuses still needs to be improved.

For example, if a developer storing member in which toner is stored and a paper feeding cassette in which recording media are stored need to be loaded and unloaded in different directions, the replacing of the developer storing member and the paper feeding cassette may be difficult for a new user who is not accustomed to the operation of the image forming apparatus.

If various members such as the developer storing member and the paper feeding cassette need to be loaded and unloaded in different directions, additional operational space is required in those directions. If the user disposes the image forming apparatus so that the user can easily replenish paper in the paper feeding cassette, but there is no room to load and unload the developer storing member, the user may need to move the image forming apparatus in order to replace the developer storing member. If space in which the image forming apparatus is disposed is limited, a user's operation may be restricted, too.

A color image forming apparatus uses toner of multiple colors, and usually requires multiple developer storing members each corresponding to toner of a color. It is preferable that, when the user handles the multiple developer storing members, the user can see them. Accordingly, it is preferable that the multiple developer storing members be disposed in the upper portion of a color image forming apparatus, and that a developer storing member that is disposed close to the user does not hide another developer storing member. Additionally, as described in Document 3, if a member that covers the multiple developer storing members need to be opened in a direction so as to expose the developer storing members, for example, it is preferable that the member opened in the direction does not hide the developer storing members.

Furthermore, if the loading unit is provided in an upper portion of an image forming apparatus so as to make the image forming apparatus compact with a first print time (a time period required for the first page to be output from the image forming apparatus) being reduced, the discharging unit may be provided at a position higher than that of the loading unit. The discharging unit positioned higher than the loading unit may make the multiple developer storing members difficult to be seen.

It is preferable that a tandem-type image forming apparatus be able to hold a large amount of image-formed paper P on its loading unit.

In the case of an image forming apparatus of which the top face is a loading unit, the image-formed paper P is discharged from a discharging unit generally located at a side of the loading unit and at a higher position than the loading unit. As a result, the quantity of the image-formed paper P is restricted by the height of the discharging unit from the surface of the loading unit.

If the height of the stacked image-formed paper P exceeds the height of the discharging unit, the stacked image-formed paper P blocks the flow of image-formed paper P discharged from the discharging unit.

If the stacked image-formed paper is as high as the discharging unit, image-formed paper stacked on the top is moved by image-formed paper discharged from the discharging unit. As a result, if the height of the stacked image-formed paper P is increased, it becomes difficult to stack another piece of image-formed paper P on the top of the stacked image-formed paper P. If the loading unit is not slanted, this problem becomes apparent.

If the height of the discharging unit is increased, or the surface of the loading unit is lowered, the distance between the lowest portion of the loading unit and the discharging unit is increased, and consequently, a large amount of image-formed paper can be stacked.

However, if the discharging unit of a conventional image forming apparatus (disclosed in the above documents, for example) is increased, the height of the conventional image forming apparatus needs to be increased. Additionally, the transport path of a recording medium up to the discharging unit becomes long, which increases risk of paper jamming and first print time (time period for the first page to be discharged). These problems additionally need to be considered separately.

Furthermore, the transportation of an image forming apparatus requires appropriate cushioning. If the discharging unit is made high and as a result, protrudes from the main body of the image forming apparatus, the cushioning and transportation may incur additional cost.

Alternatively, the surface of the loading unit may be made low instead of changing the position of the discharging unit. However, there are various components under the loading unit in the main body of an image forming apparatus, and it is not easy to lower the surface of the loading unit.

In the case of a conventional image forming apparatus disclosed in the above document 2, the intermediate transfer unit needs to be disposed almost horizontally. As a result, the image forming apparatus may become long in the horizontal directions.

If developer supplying units are provided separately from corresponding developing units, and the supply paths from the developer supplying units to the corresponding developing units differ in length, the resistances to toner that flows through the supply paths become different. As a result, the deviation in the resistances may cause the time periods required for supplying toner and the amounts of toner to deviate.

The preferred embodiments according to the present invention are described below with reference to the drawings.

An image forming apparatus according to the present embodiment is a printer that can form full color images using the tandem method. According to another embodiment, an image forming apparatus may be a copier, a facsimile machine, or a multifunctional peripheral, for example.

The structure and operation of the printer is described with reference to FIG. 1. The main body 1 of the printer includes a paper feeding unit 2 in the lower portion of the main body 1 and a image forming unit 3 above the paper feeding unit 2.

The paper feeding unit 2 is provided with a paper feeding cassette 45 in which paper P (recording medium) is provided.

The image forming unit 3 includes an imaging unit 8, an intermediate transfer belt 7, an optical writing unit 15, and a fixing unit 22. The imaging unit 8 is provided with four sub-imaging units 8Y, 8C, 8M, and 8BK having image retaining units. The intermediate transfer belt 7 is a flexible endless belt driven by multiple rollers 4, 5, and 6. The optical writing unit 15 forms an image on each image retaining unit. The fixing unit 22 fixes a toner image on the paper P. There is a transport path R from the paper feeding unit 2 to the fixing unit 22, through which the paper P is transported. The roller 6 is disposed facing the transport path R.

The intermediate transfer belt 7 forms a triangle with its apexes corresponding to the rollers 4, 5, and 6, and the intermediate transfer belt 7 between the rollers 4 and 5 corresponds to a lower side of the triangle. A secondary transfer roller 20 is provided at a position opposite the roller 6 via the intermediate transfer belt 7. The transport path R travels between the secondary transfer roller 20 and the intermediate transfer belt 7. A belt cleaning unit 21 for cleaning the intermediate transfer belt 7 is provided at a position opposite the roller 4.

The image forming unit 3 is provided under the intermediate transfer belt 7 and opposes the lower side of the triangle formed by the intermediate transfer belt 7. A photosensitive drum 10 is provided to each sub-imaging unit, and touches the intermediate transfer belt 7. The following units are provided around the photosensitive drum 10: a charging unit 11, a developing unit 12, and a cleaning unit 13. A primary transfer roller 14 is provided at a position opposite each photosensitive drum 10 via the intermediate transfer belt 7. In the present embodiment, it is assumed that the sub-imaging units 8Y, 8C, 8M, and 8BK basically have the same structure. In FIG. 1, reference numerals are assigned only to the components of the sub-imaging unit 8BK as a representation. The sub-imaging unit 8Y, 8C, 8M, and 8BK are different in toner colors. The sub-imaging units 8Y, 8C, 8M, and 8BK store yellow, cyan, magenta, and black toner, respectively.

The optical writing unit 15 forms a latent image of a color on the surface of the photosensitive drum 10 by applying a modulated laser beam L to the surface of the photosensitive drum 10. The optical writing unit 15 is provided under the imaging unit 8.

The printer forms an image in the following manner. The photosensitive drum 10 of each sub-imaging unit 8 is rotated clock-wise by a driving unit (not shown). A uniform electric charge of a predetermined polarity is given to the surface of each photosensitive drum 10 by the charging unit 11. A laser beam L is applied to the charged surface of the photosensitive drum 10 by the optical writing unit 15 thereby to form a latent image. The latent image formed on each photosensitive drum 10 corresponds to a component image of a single color (yellow, cyan, magenta, or black) into which a full color image that is to be printed is separated. When the latent image formed on the photosensitive drum 10 passes through the developing unit 12, the latent image is made visible by the developing unit 12 into a toner image.

One of the rollers 4, 5, and 6 is rotated by a driving unit (not shown) counter clock-wise, and the intermediate transfer belt 7 is driven counter clock-wise by the rotated roller. The other rollers that are not driven by the driving unit (not shown) follow the movement of the intermediate transfer belt 7.

The sub-imaging unit 8Y forms a yellow toner image on the intermediate transfer belt 7 using the development unit 12 provided therein. The yellow toner image is transferred to the intermediate transfer belt 7 by the transfer roller 14. Similarly, a cyan toner image, a magenta toner image, and a black toner image formed by the sub-imaging units 8C, 8M, and 8BK, respectively, are superposed in that order on the yellow toner transferred on the intermediate transfer belt 7 thereby to form a full color toner image.

Even though the toner image is transferred to the intermediate transfer belt 7, a small amount of toner remains on the surface of each photosensitive drum. The remaining toner is removed by the cleaning unit 13. After the remaining toner is removed, a discharging unit (not shown) removes the electric charge given to the surface of the photosensitive drum 7 thereby to restore the surface of the photosensitive drum 7 to the initial condition.

On the other hand, paper P is provided from the paper feed unit 2 into the transport path R, and transported to a portion at which the roller 6 and the secondary transfer roller 20 are opposed. A resist roller 24 provided upstream of the secondary transfer roller 20 determines when the paper P is provided.

The secondary transfer roller 20 is given a potential of polarity being opposite that of the surface of the intermediate transfer belt 7 retaining the toner image. The opposite potential causes the toner image on the surface of the intermediate transfer belt 7 to be transferred onto the paper P as a whole. After the toner image is transferred to the paper P, the paper P is transported to the fixing unit 22. The fixing unit 22 provides heat and pressure to the toner image thereby to fix the toner image.

The paper P is further transported to the discharging unit 23 disposed at the end of the transport path R. The discharging unit 23 is provided at an upper position of the main body 1 of the printer. The paper P is discharged to the loading unit 36 on the top face of the main body 1. The cleaning unit 21 removes toner remaining on the intermediate transfer belt 7 after the toner image is transferred to the paper P.

As described above, the printer according to the present embodiment is provided with four sub-imaging units 8Y, 8M, 8C, and 8BK opposing the intermediate transfer belt 7, and the four sub-imaging units 8Y, 8M, 8C, and 8BK transfer and superpose corresponding toner images on the intermediate transfer belt 7. The printer according to the present embodiment can form an image much quicker than a printer having an imaging unit. Additionally, since the loading unit 36 is provided on the top face of the main body 1, the loading unit 36 does not protrude from the main body 1. Accordingly, the footprint of the main body of the printer can be made compact.

It is assumed that the printer forms a full color image on the paper P. The printer according to the present embodiment can form a monochrome image using one of the sub-imaging units 8. The printer can also form an image of two colors or three colors. If a monochrome (gray scale) image is to be printed, for example, a latent image is formed on the photosensitive drum 10 of the sub-imaging unit 8BK. The latent image is developed by the sub-imaging unit, transferred to the paper P, and fixed by the fixing unit 22.

The printer according to the present embodiment is further described in detail.

The discharging unit 23 discharges the paper P on which an image has been formed (image-formed recording medium) on the loading unit 36 formed on the top face of the main body 1. The discharging unit 23 is formed in the top right portion of the main body 1. The discharging unit 23 is covered by a portion 1A of the facing of the main body 1. An operations panel 60 and a tray 46 for stacking paper P are provided on the facing (portion) 1A. The operations panel 60 and the tray 46 are operable from the front face side of the main body 1 (the right face shown in FIG. 1). The right side of the main body 1 shown in FIG. 1 is the operation side of the printer according to the present embodiment.

A diaphragm 50 is provided under the loading unit 36 in the main body 1. The diaphragm 50 is disposed between the loading unit 36 and the upper side of the intermediate transfer belt 7. The diaphragm 50 forms a storage space 51 in the main body, and the developer storage members are stored in the storage space 51. Multiple toner containers 37, 38, 39, and 40 are arranged in parallel in the storage space 51 under the loading unit 36 in directions (indicated by arrows C1 and C2 in FIG. 1) extending from and approaching to the discharging unit 23. The arrow C1 indicates an extending direction from the discharging unit 23. The paper P is discharged in this direction from the discharging unit 23. The arrow C2 indicates an approaching direction to the discharging unit 23. Yellow toner, cyan toner, magenta toner, and black toner are contained in the toner containers 37, 38, 39, and 40, respectively. The toner containers 37, 38, 39, and 40 are connected to the developing units 12 provided in respective sub-imaging units 8Y, 8C, 8M, and 8BK. When the amount of toner stored in the developing unit 12 decreases down to a certain level, the developing unit 12 is refilled with toner by the corresponding toner container.

As shown in FIG. 1, four toner containers 37, 38, 39, and 40 are arranged in the storage space 51. The distance of the four toner containers 37, 38, 39, and 40 from the discharging unit increases in that order, and the height of the four toner containers 37, 38, 39, and 40 from the bottom of the main body 1 also increases in that order. For example, the toner container 37 is the closest to the discharging unit 23, and is the lowest above the bottom of the main body 1. The toner container 40 is the most distant from the discharging unit 23, and is the highest above the bottom of the main body 1. The discharging unit 23 is disposed at a higher position than the position of the toner container 37, and is disposed at a position substantially as high as the position of the toner container 40.

A holder 52 is provided in the storage space 51, and detachably holds the four toner containers 37, 38, 39, and 40. The holder 52 is configured so that the toner containers 37, 38, 39, and 40 can be detached from the holder 52 by being lifted up in a space over the main body 1, where the width of the space (indicated as "D1" in FIG. 2) perpendicular to the directions C1 and C2 is as great as that of the main body 1. The toner containers 37, 38, 39, and 40 are disposed at certain positions in the main body 1 by being attached to the holder 52. That is, the toner containers 37, 38, 39, and 40 can be attached to and be detached from the main body 1.

Figure 3:
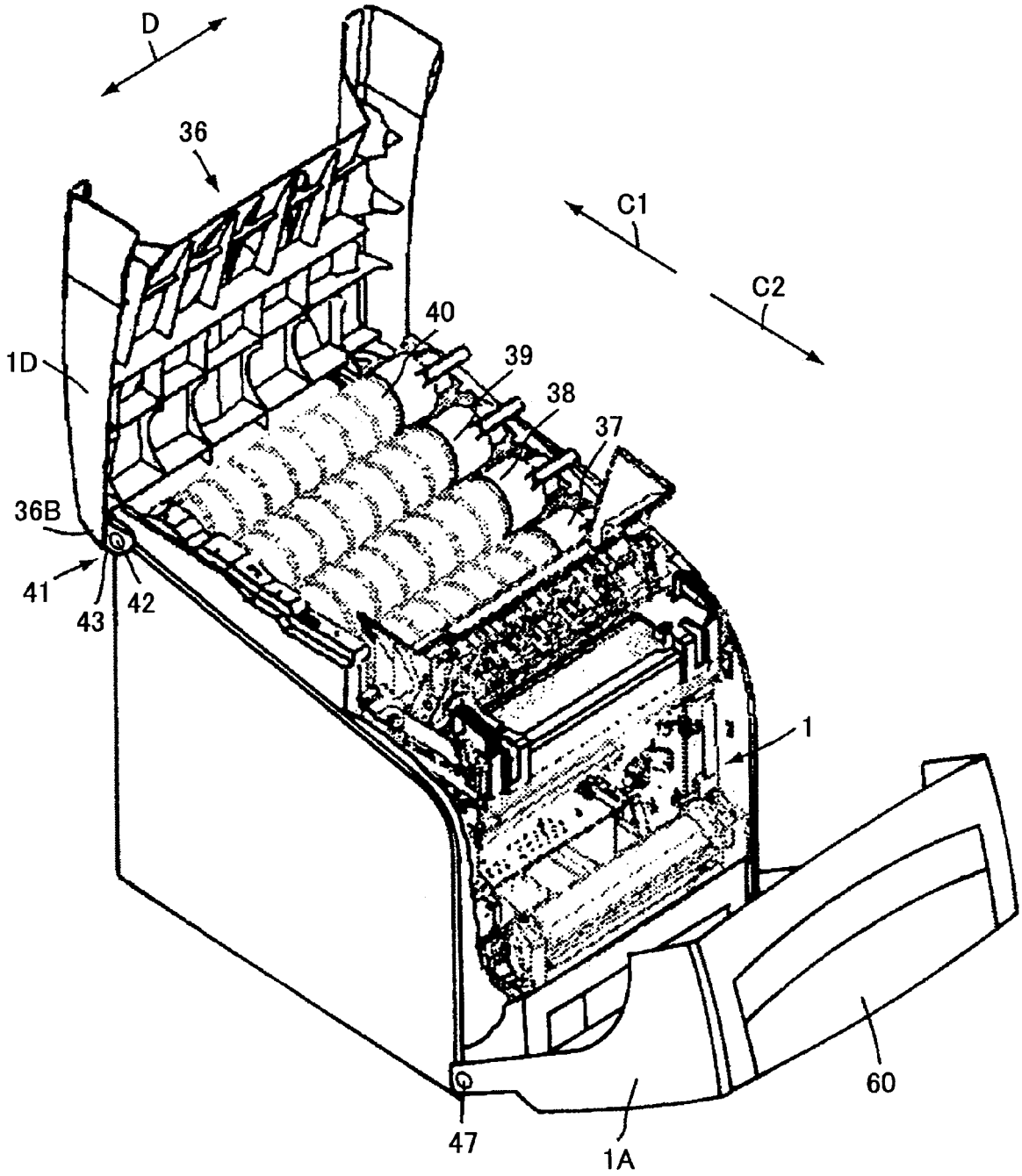
FIG. 3 is a perspective view showing the appearance of the image forming apparatus with its loading unit cover and apparatus body cover open seen from the front side.

The loading unit 36 is a portion of the facing (indicated as "1D" in FIG. 1) of the main body 1. The loading unit 36 extends from the portion below the discharging unit 23 to the direction C1. The loading unit 36 covers the toner containers 37, 38, 39, and 40 stored in the storage space 51. The loading unit 36 can be opened and be closed around a center unit 41 that is provided on the main body 1E more distant from the discharging unit 23 than the toner container 40. The center unit 41 is provided at a position lower than the top 40A of the toner container 40. As shown in FIGS. 1 and 3, the center unit 41 includes an axle unit 42 provided to the main body 1 and a bearing unit 43 provided to an end 36B of the loading unit 36. The axis of the axle unit 42 is parallel to the width directions "D" (indicated in FIG. 3) of the main body 1 that is perpendicular to the directions C1 and C2. The bearing unit 43 is supported by the axle unit 42. According to the above arrangements, an end of the loading unit 36, configured by the facing 1D, that is close to the discharging unit 23 can be lifted rotatively around the center unit 41. That is, the loading unit 36 opens in the direction C1 in which the loading unit 36 extends from the discharging unit 23. The end of the loading unit 36 can be lifted up to a higher position than the facing 1A is.

The area of the loading unit 36 is a little larger than the area of the paper P that can be provided from the paper feeding unit 2. The loading unit 36 is slanted in the manner in which the end unit 36A of the loading unit 36 close to the discharging unit 23 is lower than the end unit 36B of the loading unit 36 distant from the discharging unit 23.

The end unit 36A is the lowest portion of the loading unit 36, and is disposed at a position lower than a paper discharge point of the discharging unit 23 through which the paper P is discharged. The end unit 36B of the loading unit 36 is substantially as high as the highest portion 1C of the facing 1A as shown in FIG. 1.

Figure 8:
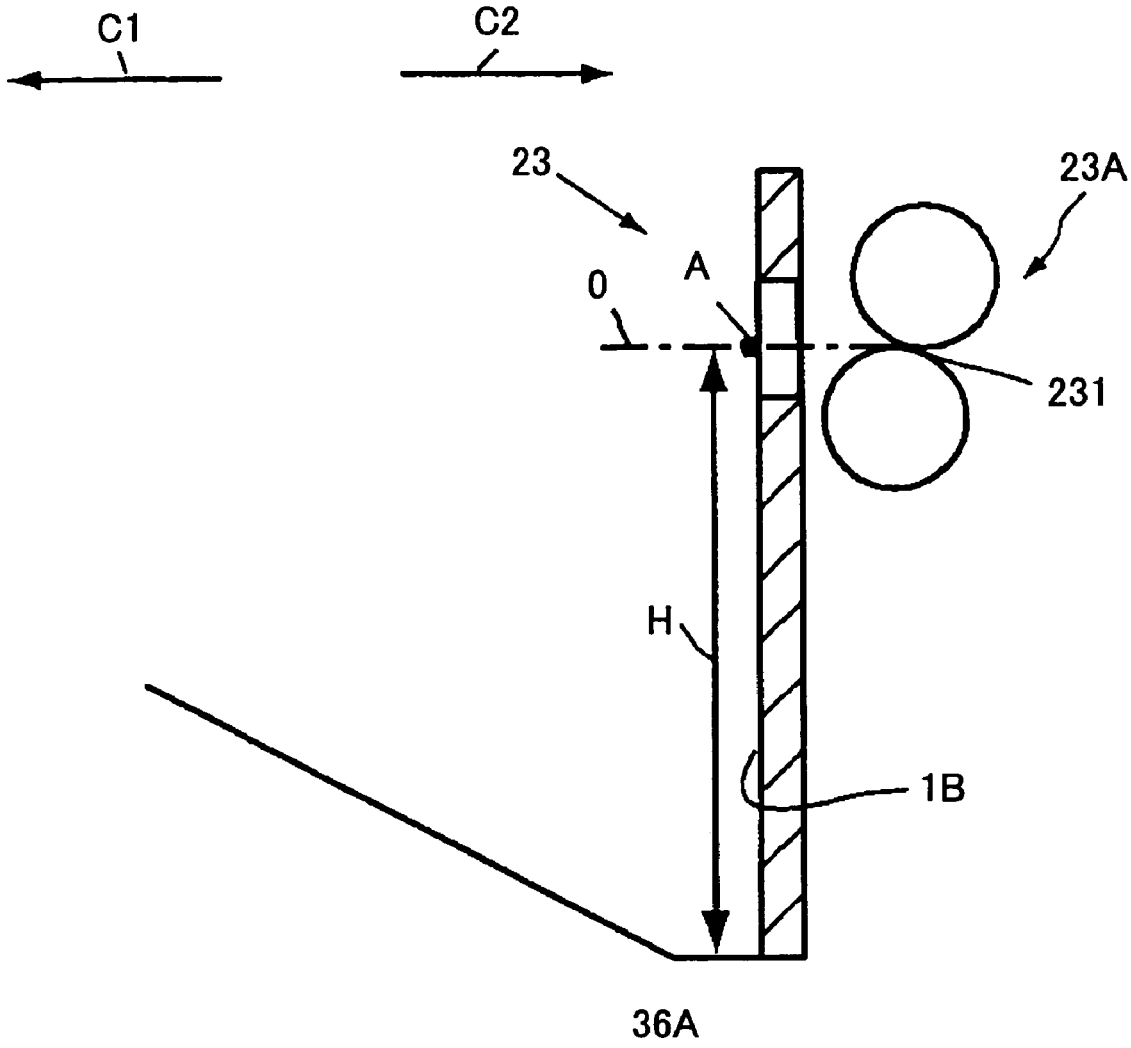
FIG. 8 is an expanded cross-sectional view showing the distance between a paper discharging point of a discharging unit and an end of the loading unit.

FIG. 8 is a schematic diagram for explaining the relation of the discharging unit 23 and the end unit 36A of the loading unit 36.

The discharging point is indicated by "A" in FIG. 8. As described above, the discharging point "A" is a crossing point between a horizontal line "O" from a nip unit 231 of a pair of discharging rollers 23A disposed substantially in the vertical direction, the pair of discharging rollers 23A opposing and touching each other, and a facing 1B facing the loading unit. The end unit 36A of the loading unit 36 is disposed at a lower position than the highest portion 37A of the toner container 37.

As described above, the toner containers 37, 38, 39, and 40 can be attached to and detached from the main body 1, and only space as wide as the main body 1 (of width D1) is required for attaching (and detaching) the toner containers 37, 38, 39, and 40 to (from) the main body 1. Accordingly, the user can replace the toner containers 37, 38, 39, and 40 within the space over the main body 1.

The more distant from the discharging unit 23 the toner container is, the higher the toner container is disposed. As a result, all of the toner containers 37, 38, 39, and 40 can be seen at least in part from the operation side (discharging unit 23 side). For example, the user can see the toner container 38 over the toner container 37. The greater is the height difference between adjacent toner containers, the greater is the portion of the toner container visible to the user. The discharging unit does not hide the toner containers 37, 38, 39, and 40. Because the user can look at the toner containers 37, 38, 39, and 40, the user can easily handle them.

Because the toner containers 37, 38, 39, and 40 are arranged as described above, the loading unit 36 can be formed in the manner in which an end unit 36A close to the discharging unit 23 is lower than an end unit 36B distant from the discharging unit 23. As a result, the distance between the discharging unit 23 and the loading unit 36 (the end unit 36A) can be increased without moving the discharging unit 23 upward. It is possible to increase the amount of paper P that can be stacked on the loading unit 36.

The loading unit 36 can be lifted and opened by being rotated around a center unit 41 provided at a portion 1E of the main unit 1 that is more distant from the discharging unit than the toner container 40. When the loading unit 36 is opened, the loading unit 36 does not hide the toner container 40 much. As shown in FIG. 3, the loading unit 36 opens in a manner so that the loading unit 36 becomes distant from the operation side (discharging unit 23). Accordingly, the user can see the toner containers 37, 38, 39, and 40 exposed by opening the loading unit 36, and easily handle the toner containers 37, 38, 39, and 40.

The center unit 41 is disposed at a lower position than the top portion of the toner container 40 so that, when the loading unit 36 is opened, the height of the opened loading unit 36 does not become too high. As a result, the height of the main body 1 is prevented from becoming too great.

The loading unit 36 is configured in a manner so that the loading unit 36 can be lifted up to a higher position than the facing 1A, on which the operations panel 60 is disposed, is opened to. Accordingly, the user can see the toner containers 37, 38, 39, and 40 from the operation side, and easily handle the toner containers 37, 38, 39, and 40.

The loading unit 36 is disposed higher than the toner container 37, and is disposed substantially as high as the toner container 40. As a result, the main body is prevented from being too tall, and at the same time, the end unit 36A of the loading unit 36 can be disposed sufficiently lower than the discharging unit 23 so as to increase the amount of paper P that is stacked on the loading unit 36. That is, the end unit 36A is the lowest portion of the loading unit 36, and the loading unit 36 is formed in a manner in which the end unit 36A is disposed at a lower position than the discharging point. Since the distance (difference in height) between the discharging point and the end unit 36A of the loading unit 36 can be increased, the amount of paper P that is stacked on the loading unit 36 can be increased.

The highest portion 1C of the facing 1A is substantially as high as the end unit 36B of the loading unit 36. As a result, the distance between the discharging unit 23 and the loading unit 36 can be increased without increasing the height of the main body 1. Accordingly, the amount of paper P that can be stacked on the loading unit 36 can be increased.

The end unit 36A of the loading unit 36 is disposed at a lower position than the highest portion 37A of the toner container 37. As a result, the distance between the discharging unit 23 and the loading unit 36 can be increased without increasing the height of the main body 1. Accordingly, the amount of paper P that can be stacked on the loading unit 36 can be increased.

The facing 1D functions as a facing of the main body 1 as well as the loading unit 36. As a result, the number of components does not need to be increased. Additionally, since a slope is formed on the facing of the main body 1, not only is the volume of the main body 1 reduced, but also the main body 1 looks compact.

The paper feeding cassette 45 and the tray 46 are described below.

The paper feeding cassette 45 can be loaded and unloaded to the main body 1 by sliding. The paper feeding cassette 45 slides in directions of extending from and approaching to the discharging unit 23 (indicated by the arrows C1 and C2). As a result, the paper feeding unit 45 can be loaded and unloaded within the range of width D1 of the main body 1. Even if there is an obstacle in the width direction of the main body 1, the user does not need to move the main body 1 for opening the loading unit 36 and loading the paper feeding cassette 45.

The paper feeding cassette 45 can be loaded and unloaded to the main body 1 by sliding it in the directions indicated by the arrows C1 and C2. Accordingly, the user can load and unload the paper feeding cassette 45, and can open the loading unit 36 from the operation side of the main body 1.

The tray 46 is provided on the facing 1A of the main body 1 in the manner in which a lower portion of the tray 46 is rotatablely supported by an axle 44. The axis of the axle 44 is parallel to the width directions D of the main body 1. The tray 46 can be stored in the facing 1A, and can be opened by rotating in rotative directions indicated by an arrow F1 in FIG. 1. That is, the tray 46 can be opened in the backward direction by extending it from the operation side.

As a result, the tray 46 can be opened within a range of the width D1 of the main body 1. Even if there is an obstacle beside the main body 1 in the width direction D, the user does not need to move the main body 1 for opening the tray 46.

As described above, the tray 46 can be closed by storing it in the facing 1A in the forward direction (indicated by the arrow C1), and be opened by pulling it out of the facing 1A in the backward direction (indicated by the arrow C2). Accordingly, the user can handle the tray 46 from a position facing the operation side of the main body 1.

Figure 2:
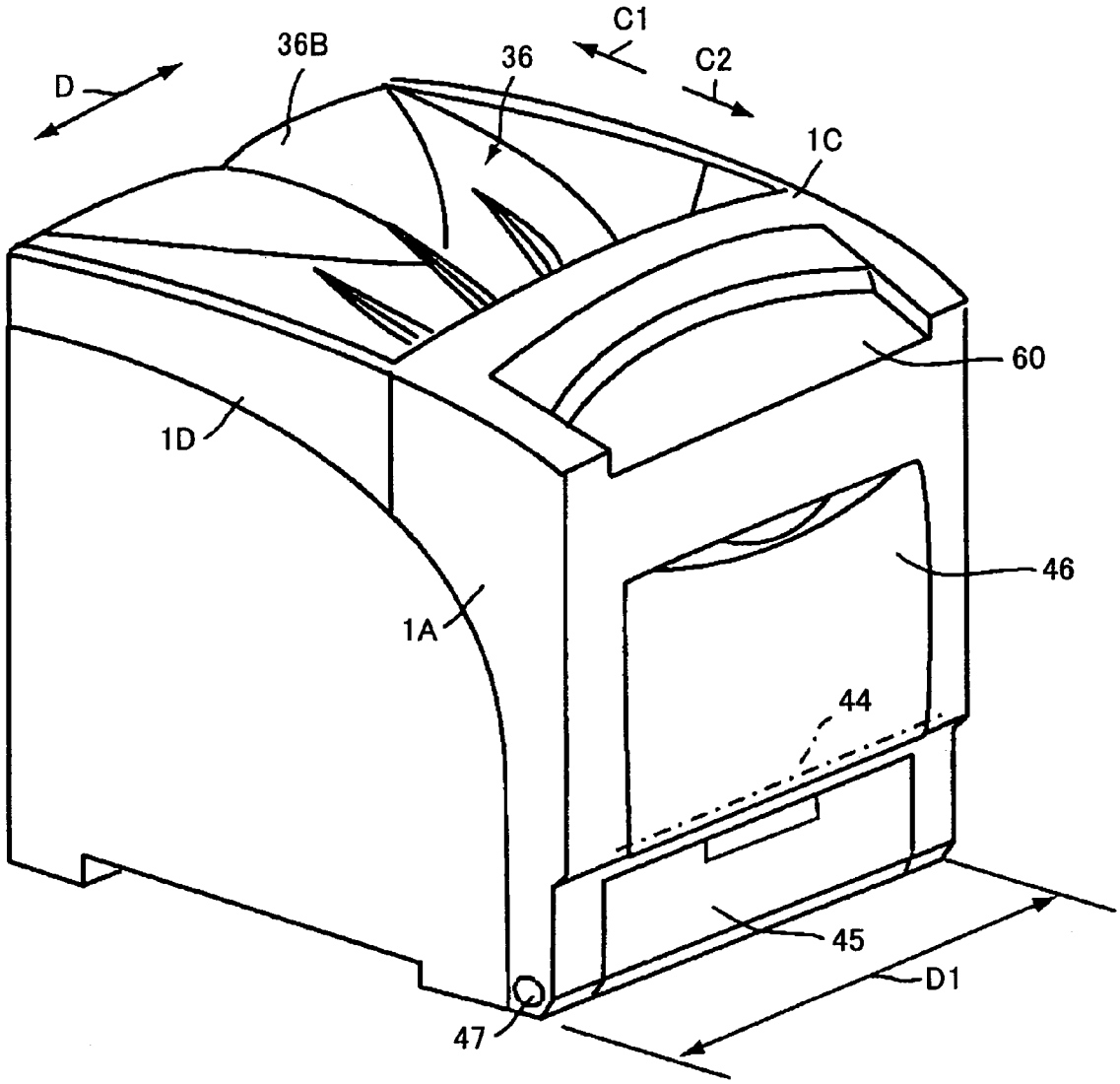
FIG. 2 is a perspective view showing the appearance of the image forming apparatus seen from the front side.

As shown in FIGS. 2 and 3, the facing 1A can be opened by rotating it around an axle unit 47 disposed at a lower portion of a side face of the main body 1. The axis of the axle unit 47 is also parallel to the width direction D of the main body 1. The facing 1A opens in the backward direction (indicated by the arrow C2), and closes in the forward direction (indicated by the arrow C1). The user can handle the facing 1A from the operation side of the main body 1 in the same manner in which the user opens and closes the tray 46 and the loading unit 36. As a result, the user can easily operate and maintain the printer.

Figure 4:
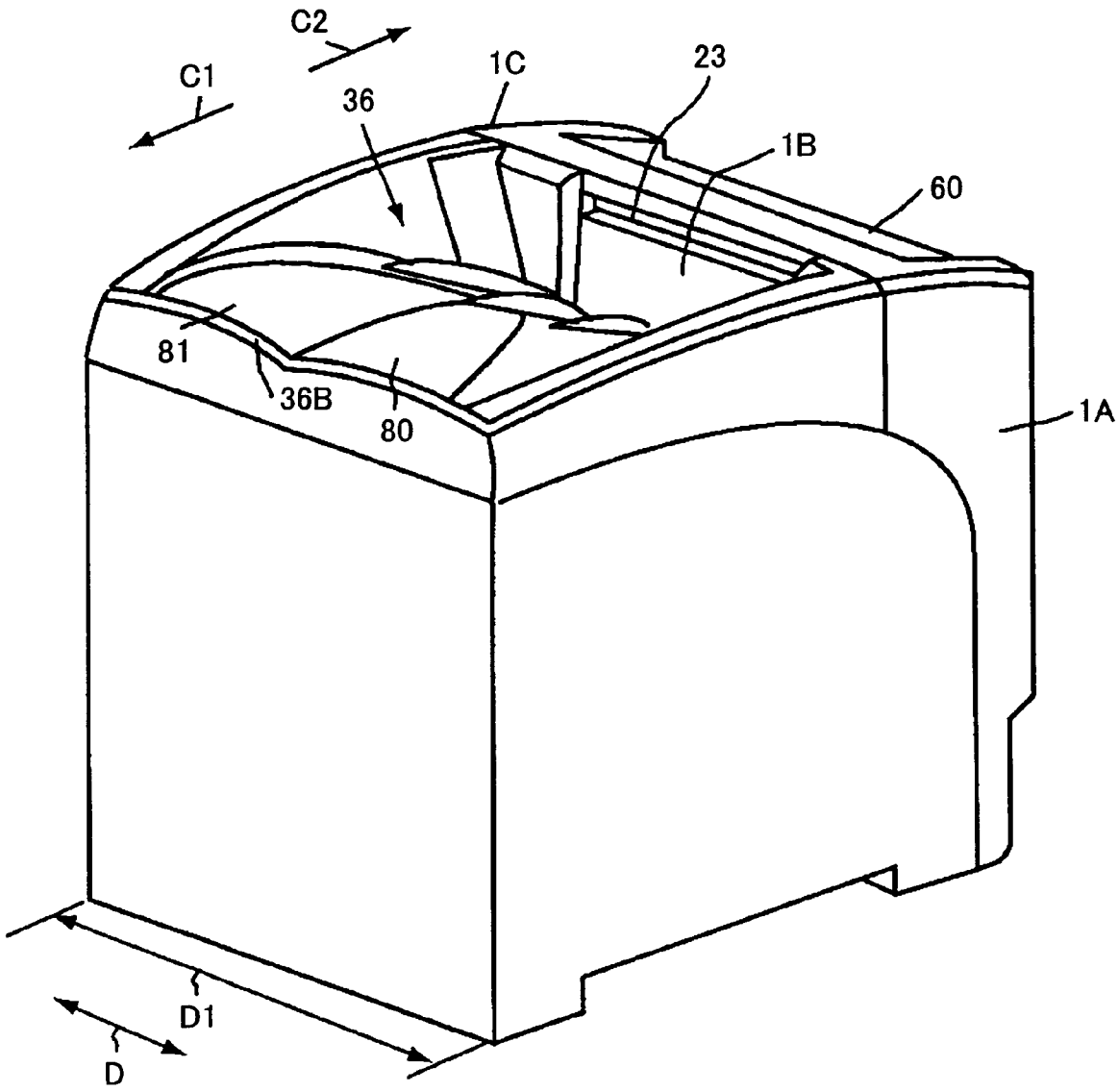
FIG. 4 is a perspective view showing the appearance of the image forming apparatus seen from the rear side.
Figure 5:
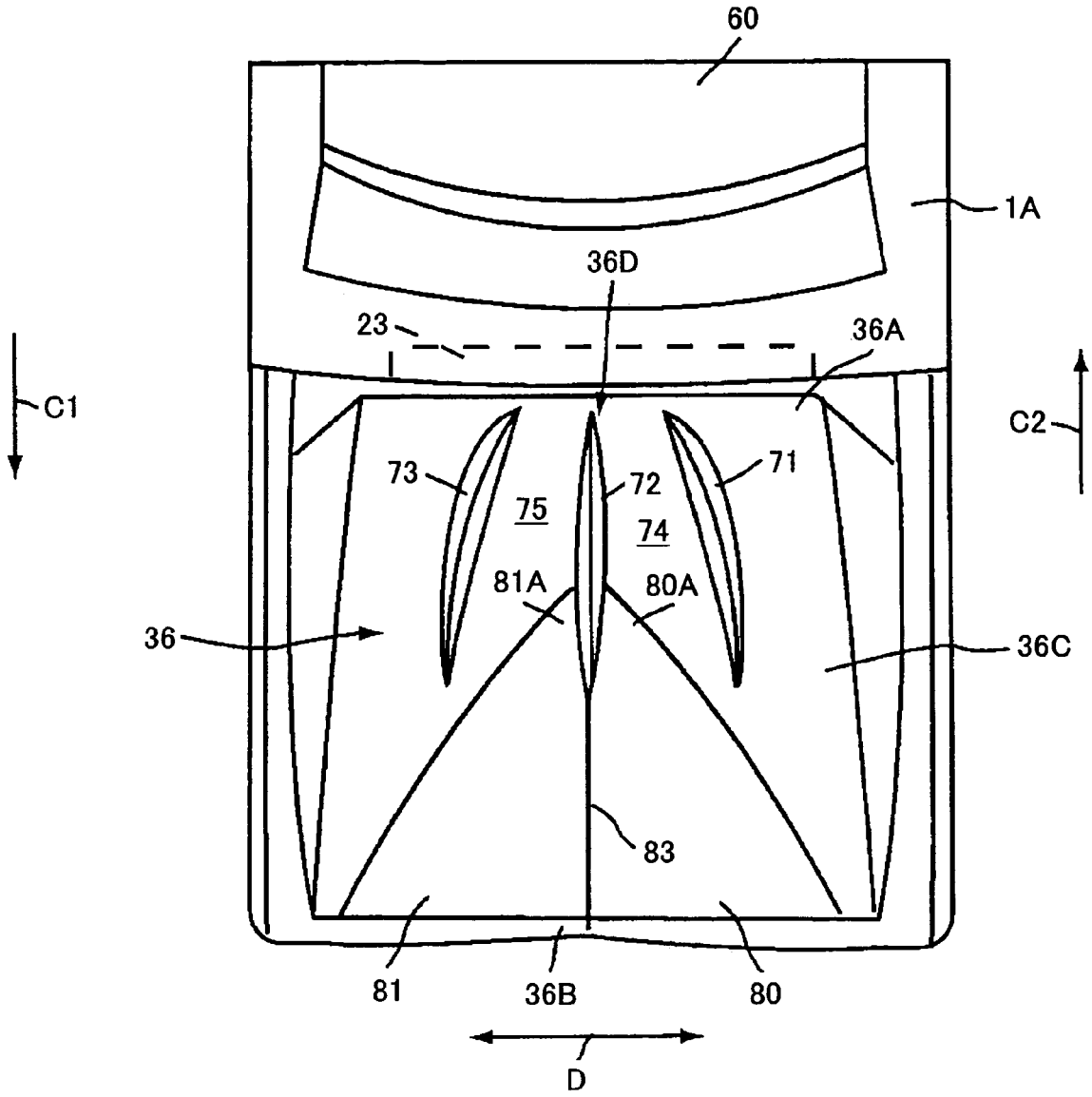
FIG. 5 is a plan view of the image forming apparatus.

As shown in FIGS. 4 and 5, multiple ribs 71, 72, and 73 are provided on the loading unit 36. The ribs 71, 72, and 73 extend substantially spoke-wise from the center 36D of the end unit 36A in the forward directions (indicated by the arrow C1). The ribs 71, 72, and 73 are separated by width 74 and 75 in the width direction D. The ribs 71, 72, and 73 are disposed substantially in the range between the end unit 36A and the center of the loading unit 36.

Figure 6:
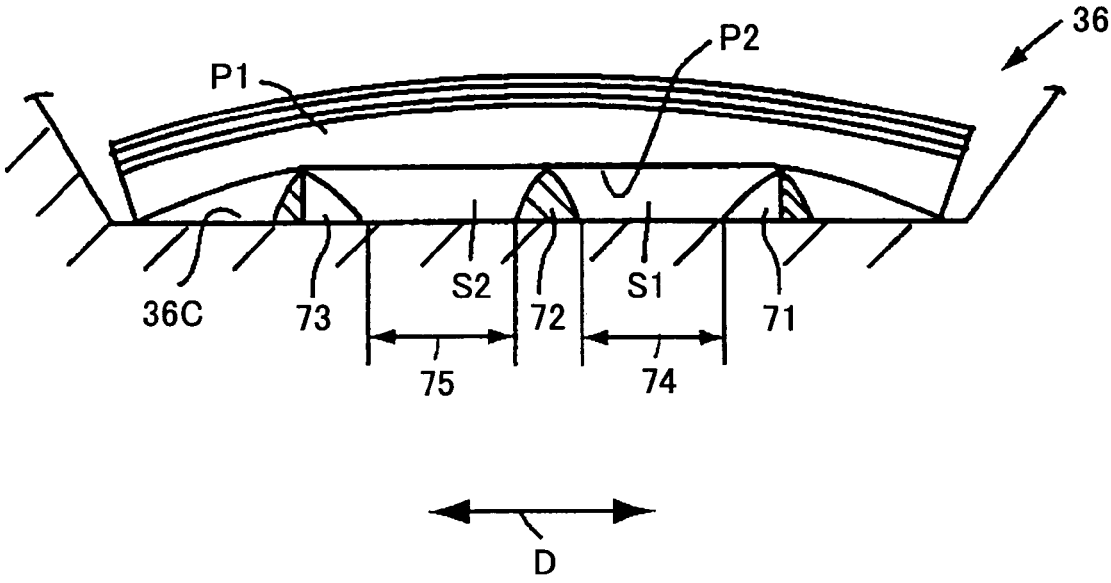
FIG. 6 is an expanded view for explaining the configuration and function of multiple ribs provided on the loading unit of the image forming apparatus.

As shown in FIGS. 1 and 6, the ribs 71, 72, and 73 protrude upward from the surface 36C of the loading unit 36. According to the present embodiment, the ribs 71, 72, and 73 are formed with the facing 1D configuring the loading unit 36 as one unit. According to another embodiment, the ribs 71, 72, and 73 may be formed separately from the facing 1D, and be attached to the facing 1D afterward. The ribs 71, 72, and 73 are provided for the image-formed paper P, the length of which in the discharging directions is about a half of the surface 36C of the loading unit 36.

As shown in FIG. 6, the ribs 71, 72, and 73 provided on the surface 36C of the loading unit 36 form spaces S1 and S2 between the lower face of the stacked image-formed paper P1 and the surface 36C of the loading unit 36. When the user picks up the stacked image-formed paper P1 from the loading unit 36, the user can insert her fingers into the spaces S1 and S2. As a result, the user can easily pick up the stacked image-formed paper P1.

Since the ribs 71, 72, and 73 are disposed spoke-wise from the center 36D of the end unit 36A of the loading unit 36, the distance between adjacent ribs (the ribs 71 and 72, for example) is increased at the side opposite the end unit 36A. The user can insert her fingers into the space S1 and S2, and pick up the stacked image-formed paper P1 more easily.

The three ribs 71, 72, and 73 are separated in the width directions by distances 74 and 75. As a result, even if the amount of paper P stacked on the loading unit 36 is great, the ribs 71, 72, and 73 can prevent the paper P from being bent by its own weight, and secure the spaces S1 and S2 formed between the surface 36C of the loading unit 36 and the bottom face P2 of the image-formed paper P1. The user can easily pick up a large amount of paper P1 stacked on the loading unit 36.

As shown in FIGS. 4 and 5, multiple curves 80 and 81 are formed from the end unit 36B to the center of the loading unit 36. The center of each curve 80 and 81 protrudes upward from the surface 36C of the loading unit 36.

The curves 80 and 81 are formed in the width direction D. A boundary 83 between the two curves 80 and 81 is formed at the center of the surface 36C in the width directions D, and is lower than the curves 80 and 81. If the curves 80 and 81 are viewed from overhead, the curves 80 and 81 look like triangles as shown in FIG. 5, the width of which in the width direction D is wide at the end unit 36B side, and becomes narrow as the discharging unit 23 is approached. The apex 80A (or 81A) of the curve 80 (or 81) extends up to the rib 72 disposed at the center of the surface 36C. The curves 80 and 81 are provided for the image-formed paper P1 so that, when discharged from the discharging unit 23, the edge of the image-formed paper P1 reaches the end unit 36B of the loading unit 36. The ribs 71, 72, and 73 are provided for the convenience of landscape printing, and the curves 80 and 81 are provided for the convenience of portrait printing.

Figure 7:
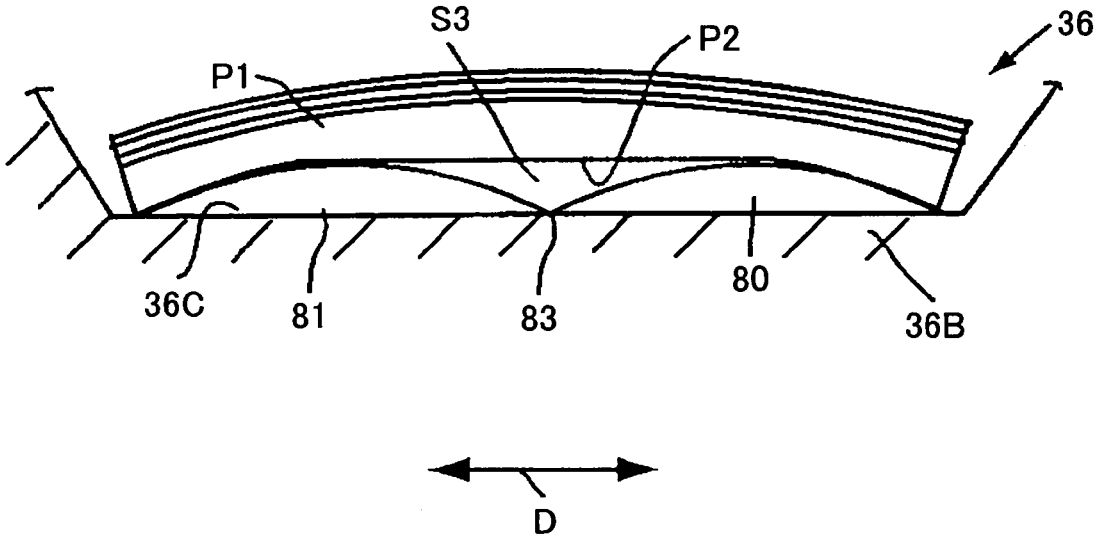
FIG. 7 is an expanded view for explaining the configuration and function of multiple curvatures provided on the loading unit of the image forming apparatus.

As described above, the curves 80 and 81 are provided in a range between the end unit 36B of the loading unit 36 and the center thereof, the curves 80 and 81 extending upward from the surface 36C. The image-formed paper P1 is stacked on the curves 80 and 81 as shown in FIG. 7. As a result, the curves 80 and 81 form space S3 between the bottom face P2 of the image-formed paper P1 and the surface 36C in the neighborhood of the boundary 83. When the user picks up the stacked image-formed paper P1 from the end unit 36B side, the user can insert her fingers into the space S3, and easily pick up the paper P1.

The quantity of the curves 80 and 81 is not limited to two, and may be increased depending on the size and the physical properties of the paper P. However, if too many curves are formed, the space 83 may become too small for the user to insert her fingers. The quantity of the curves may be determined so that enough space 83 remains.

The present embodiment further includes a unique configuration. The unique configuration is that the intermediate transfer belt 6, the imaging unit 8, and the optical writing unit 15 are disposed in the main body 1, slanted in the same manner as the toner containers 37–40, and the loading unit 36 is slanted in the same manner as the toner containers 37–40. As a result, the end unit 36A of the loading unit 36 can be easily lowered, and consequently, the distance between the discharging unit and the end unit 36A can be increased without increasing the height of the main body 1 compared with a configuration in which the intermediate transfer belt 6, the imaging unit 8, and the optical writing unit 15 are disposed horizontally. The angle of the slope of the loading unit 36 can be easily increased so that a greater amount of paper P can be stacked.

Additionally, since the loading unit 36, the toner containers 37–40, the intermediate transfer belt 6, the imaging unit 8, and the optical writing unit 15 are slanted, the length of the main body 1 in the forward and backward directions can be reduced. The footprint of the printer according to the present embodiment becomes more compact than a printer in which the above elements are provided horizontally.

The present invention is not limited to these embodiments, but variations and modifications may be made without departing from the scope of the present invention.

This patent application is based on Japanese Priority Patent Applications No. 2003-113245 filed on Apr. 17, 2003, and No. 2003-113256 filed on Apr. 17, 2003, the entire contents of which are hereby incorporated by reference.

What is claimed is:

1. An image forming apparatus, comprising:

a loading unit forming at least a portion of a top face of the image forming apparatus;

a discharging unit disposed on the top face of the image forming apparatus, wherein image-formed recording media are discharged through the discharging onto the loading unit; and a plurality of developer containing members disposed in the image forming apparatus under the loading unit, the developer containing members being arranged in a direction extending from an operation side of the image forming apparatus, and the developer containing members configured to provide corresponding imaging units with developer;

wherein the developer containing members are detachable from the image forming apparatus, and each developer containing member can be handled within a space above the image forming apparatus without changing an orientation thereof;

the more distant the developer containing member is from the discharging unit, the higher the developer containing member is disposed; and the loading unit can be opened around a rotative center unit disposed at a position beyond the developer containing members from the operation side of the image forming apparatus.

2. The image forming apparatus as claimed in claim 1, wherein the rotative center unit is disposed at a position lower than a highest portion of the developer containing member that is most distant from the discharging unit.

3. The image forming apparatus as claimed in claim 1, wherein the rotative center unit includes an axle unit provided in the main body, the axis of the axle unit being in width directions of the main body, and a bearing unit provided in the loading unit, the bearing unit being supported by the axle unit.

4. The image forming apparatus as claimed in claim 1, wherein the loading unit can be opened in directions extending from and approaching to the operation side.

5. The image forming apparatus as claimed in claim 1, further comprising:

an operations panel disposed on a facing of the main body positioned at the operation side of the image forming apparatus;

wherein the loading unit can be rotatively opened to a position higher than the facing on which the operations panel is disposed.

6. The image forming apparatus as claimed in claim 5, wherein a highest portion of the loading unit is as high as a highest portion of the facing on which the operations panel is disposed.

7. The image forming apparatus as claimed in claim 1, wherein a lowest portion of the loading unit is lower than a highest portion of the developer containing member disposed at a lowest position.

8. The image forming apparatus as claimed in claim 1, further comprising:

a paper feeding cassette detachably provided in the main body, the paper feeding cassette storing a recording medium on which an image is to be formed.

9. The image forming apparatus as claimed in claim 8, wherein the paper feeding cassette can be attached to and detached from the main body in directions extending from and approaching to the operation side of the main body.

10. The image forming apparatus as claimed in claim 1, further comprising:

an openable tray provided on the main body, on which a recording medium can be stacked;

wherein the loading unit and the openable tray can be opened within a range of a width of the main body.

11. The image forming apparatus as claimed in claim 10, wherein the openable tray can be opened backward from the operation side.

12. The image forming apparatus as claimed in claim 1, wherein the loading unit is a portion of a facing of the main body covering the developer containers.

13. The image forming apparatus as claimed in claim 1, wherein the loading unit extends from an end unit under the discharging unit to a direction extending from the discharging unit, and has a plurality of ribs protruding upward thereon.

14. The image forming apparatus as claimed in claim 13, wherein the manner in which the ribs are disposed is substantially spoke-wise from a center at an end unit side of the loading unit.

15. The image forming apparatus as claimed in claim 13, wherein the quantity of the ribs is three.

16. The image forming apparatus as claimed in claim 1, wherein a plurality of curves protruding upward is formed on a surface of the loading unit in width directions.

17. The image forming apparatus as claimed in claim 1, wherein the surface of the loading unit is slanted in a substantially same manner as the developer storage members are slanted.

18. The image forming apparatus as claimed in claim 1, wherein the imaging units are disposed at a slant in the same direction as the developer containing members; and a surface of the loading unit is formed at a slant in the same direction as the imaging units.

19. The image forming apparatus as claimed in claim 1, further comprising:

an intermediate transfer unit disposed at a slant substantially in the same direction as the developer containing members;

wherein an image formed by the imaging units is transferred to the intermediate transfer unit, and a surface of the loading unit is formed at a slant in the same direction as the intermediate transfer unit.

20. The image forming apparatus as claimed in claim 1, further comprising:

an optical writing unit disposed at a slant in the same direction as the developer containing members, which optical writing unit writes an image on each image retaining unit using a light beam;

wherein a surface of the loading unit is formed at a slant in the same direction as the optical writing unit.

21. The image forming apparatus as claimed in claim 1, further comprising:

an optical writing unit that writes an image on an image retaining unit using a light beam; and an intermediate transfer unit to which the image formed by the imaging unit is transferred;

wherein the imaging unit, the optical writing unit, the intermediate transfer unit, and a surface of the loading unit are provided at a slant substantially in the same direction as the developer containing members.

22. The image forming apparatus as claimed in claim 1, wherein the space required for handling the developer containing members is limited to width of the main body, the width being perpendicular to directions in which the image-formed recording medium is discharged through the discharging unit.

23. An image forming apparatus, comprising:

a loading unit forming at least a portion of a top face of the image forming apparatus;

a discharging unit disposed at on the top face of the image forming apparatus, wherein image-formed recording media are discharged through the discharging unit onto the loading unit; and a plurality of developer containing members disposed in the image forming apparatus under the loading unit, the developer containing members being arranged in a direction extending from an operation side of the image forming apparatus, and the developer containing members being configured to provide corresponding imaging units with developer;

wherein the developer containing member closest to the discharging unit is disposed at a lower position than the developer containing member most distant from the discharging; and the loading unit can be opened around a rotative center unit disposed at a position beyond the developer containing members from the operation side of the image forming apparatus.

24. The image forming apparatus as claimed in claim 23, wherein the discharging unit is disposed at a higher position than the position at which the developer containing member closest to the discharging unit is disposed, and at a lower position than the position at which the developer containing member most distant from the discharging unit is disposed.

25. The image forming apparatus as claimed in claim 23, wherein the loading unit is configured in a manner in which a lowest portion thereof is lower than a discharging point of the discharging unit.

26. The image forming apparatus as claimed in claim 23, further comprising:

an operations panel disposed on a facing of the main body positioned at the operation side of the image forming apparatus;

wherein the loading unit is configured in a manner in which a highest portion thereof is substantially as high as the facing on which the operations panel is disposed.

27. The image forming apparatus as claimed in claim 23, wherein the loading unit is configured in a manner in which a lowest portion thereof is disposed at a lower position than a position at which a highest portion of a lowest one of the developer containing members is disposed.

28. The image forming apparatus as claimed in claim 23, wherein the loading unit is a portion of a facing of the main body, the portion covering the developer containing members.

29. The image forming apparatus as claimed in claim 23, wherein the loading unit extends from an end unit positioned below the discharging unit in a direction extending from the discharging unit; and a plurality of ribs are provided on the loading unit, the ribs protruding upward from a surface of the loading unit.

30. The image forming apparatus as claimed in claim 29, wherein the ribs are disposed substantially spoke-wise from a center at a side of the end unit of the loading unit.

31. The image forming apparatus as claimed in claim 29, wherein the quantity of the ribs is three.

32. The image forming apparatus as claimed in claim 23, wherein a plurality of curves protruding upward is formed on a surface of the loading unit in directions perpendicular to a direction in which a recording medium is discharged from the discharging unit.

33. The image forming apparatus as claimed in claim 23, wherein the loading unit is configured in a manner in which a surface thereof is slanted in the same direction as the direction in which the developer containing members are arranged.

34. The image forming apparatus as claimed in claim 23, wherein the imaging units are disposed at a slant substantially in the same direction in which the developer containing members are disposed; and a surface of the loading unit is disposed at a slant substantially in the same direction in which the imaging units are disposed.

35. The image forming apparatus as claimed in claim 23, further comprising:

an intermediate transfer unit disposed at a slant substantially in the same direction as, the developer containing members;

wherein an image formed by the imaging units is transferred to the intermediate transfer unit, and a surface of the loading unit is formed at a slant in the same direction as the intermediate transfer unit.

36. The image forming apparatus as claimed in claim 23, further comprising:

an optical writing unit disposed at a slant in the same direction as the developer containing members, which optical writing unit writes an image on each image retaining unit using a light beam;

wherein a surface of the loading unit is formed at a slant in the same direction as the optical writing unit.

37. The image forming apparatus as claimed in claim 23, further comprising:

an optical writing unit that writes an image on an image retaining unit using a light beam; and an intermediate transfer unit to which the image formed by the imaging unit is transferred;

wherein the imaging unit, the optical writing unit, the intermediate transfer unit, and a surface of the loading unit are provided at a slant substantially in the same direction as the developer containing members.

38. An image forming apparatus having an operation panel on a first side, the image forming apparatus comprising:

a loading unit disposed on at least a portion of a top face of the image forming apparatus;

a discharging unit disposed on the top face of the image forming apparatus, the discharging unit being configured to discharge image-formed recording media onto the loading unit; and a plurality of developer containing members configured to provide corresponding imaging units with developer, the plurality of developer containing members being disposed under the loading unit such that the more distant a developer containing member in the plurality is from the discharging unit in a substantially horizontal direction, the higher the developer containing member is disposed in the image forming apparatus in a substantially vertical direction, wherein each of the developer containing members is detachable from the image forming apparatus and is configured to be handled within a space above the image forming apparatus without changing an orientation thereof, and the loading unit is configured to be rotationally opened around an axis horizontally located beyond the developer containing members with respect to the operation panel on the first side of the image forming apparatus.

* * * * *